United States Patent [19]

Schuh et al.

[11] Patent Number: 4,632,188

[45] Date of Patent: Dec. 30, 1986

[54] SUBSEA WELLHEAD APPARATUS

[75] Inventors: Frank J. Schuh, Plano; John Karish, Houston, both of Tex.

[73] Assignee: Atlantic Richfield Company, Plano, Tex.

[21] Appl. No.: 772,402

[22] Filed: Sep. 4, 1985

[51] Int. Cl.[4] ..... E21B 7/12

[52] U.S. Cl. ..... 166/368; 166/97.5

[58] Field of Search ..... 166/97.5, 335, 368

[56] References Cited

U.S. PATENT DOCUMENTS

| | | | |
|---|---|---|---|
| 3,536,344 | 10/1970 | Nelson | 166/368 |
| 3,545,541 | 12/1970 | DeVries | 166/368 |
| 3,885,623 | 5/1975 | Watkins et al. | 166/368 |
| 4,475,600 | 10/1984 | Cegielski et al. | 166/368 |

*Primary Examiner*—Stephen J. Novosad
*Assistant Examiner*—William P. Neuder
*Attorney, Agent, or Firm*—James C. Fails; William T. Wofford; Arthur F. Zobal

[57] ABSTRACT

An improvement in a subsea wellhead apparatus that includes the conventional plurality of strings of conduit suspended in a borehole penetrating subterranean formations below the bottom of a sea at which the wellhead apparatus will be placed and the conventional wellhead and accessories disposed above the bottom and the plurality of strings of conduit; the improvement comprising a first communications aperture communicating with a first annular space intermediate a desired pair of conduit strings; a sealed conduit that defines a sealed path of flow for flowing a fluid waste into the annulus intermediate the respective conduit strings; remotely operable high pressure control valves interposed in the conduit for controlling the flow of fluid between the annular spaces and a remote control for controlling the flow control valves so as to route the fluid waste to the first annular space and fractured formation communicating therewith.

2 Claims, 2 Drawing Figures

SUBSEA WELLHEAD APPARATUS

FIELD OF THE INVENTION

This invention relates to subsea wellhead apparatus for use at the bottom of a sea and the like; and, more particularly, to an improved subsea wellhead apparatus for injecting waste captured at the rig level down the riser or kill lines into an annulus communicating with a fractured formation and minimizing waste discharge into the sea water.

BACKGROUND OF THE INVENTION

In deep water drilling, it is necessary to discharge certain fluids in order to set two conductor strings into the upper portion of the wellbore. The reason for this is that the driller can not fracture formation and inject the fluids under the circulating pressure without fracturing back to the surface so it is necessary to set 20 inch casing to a depth sufficient that he will not fracture back to the surface, which is the sea floor. In order to do this, he use fluids that are compatible with the environment and that do not contaminate the environment. For example, the optimum drilling fluids may not be employed in this early portion and elements that are objected to, such as diesel oil, lignosulfonate muds, chrome, and the like are not employed in this early drilling. Typically, in the borehole a 30 inch conductor pipe is installed, the borehole is then drilled to the desired depth for 20 inch conductor pipe and the 20 inch conductor pipe is then inserted interiorly of the 30 inch pipe. The 20 inch conductor pipe is cemented in place with returns to the sea floor. The materials are deposited on the sea floor at the wellbore site but none of these materials are considered toxic.

With jackup rigs, after the 20 inch conductor string is cemented in place, it has been practice to fracture into a subterranean formation and then to use one annulus between the 30 inch conductor string and the 13⅜ inch casing for injecting wastes therethrough and into the fractured formation.

With the advent of floating rigs, this approach was not available, since there had been no system for reaching the annulus on the subsea stack employed with a floating rig.

In the prior art the most common subsea BOP (blowout preventor) stack on large semis is the 18¾ inch bore, 10,000 psi (pounds per square inch) working pressure stack. These are used with 18¾ inch 10,000 psi working pressure wellheads. The wellheads are run on the 20 inch conductor pipe and landed in a head attached to the 30 inch conductor pipe that is placed to start the well. The 18¾ 10,000 psi wellhead usually permit landing three or four additional strings in the head. The most common of these are the 13⅜ OD (outside diameter) surface pipe followed by 9⅝ inch OD protection casing, 7 inch OD tieback string and test tubing. Ordinarily, the conventional prior art apparatus includes conventional permanent and temporary guide bases with typical wellhead connectors and cables and other guide means for guiding the equipment to the subsea wellhead apparatus, as well as conduits, sealing stab connections and the like that will form a sealed flowpath when the stabbed connection is made with the apparatus lowered to the subsea wellhead apparatus. The risers, control lines, kill lines and the like are employed in accordance with conventional technology.

Drilling fluids are usually returned to the surface when certain geological information is desired to be obtained from the fluid and when it is to be recirculated.

In many instances of such offshore drilling, it would be exceptionally burdensome to have to accumulate and transport waste fluids by supply boat, so the drilling engineer simply uses compatible rather than toxic material and tolerates whatever drilling inefficiencies he has to.

Accordingly, it can be seen that the prior art has not solved the problem of providing a wellhead apparatus that can, at the option of the operator be employed to dispose of accumulated wastes through special conduit connectors communicating with an annulus that communicates with a fractured subterranean formation.

SUMMARY OF THE INVENTION

Accordingly, it is an obJect of this invention to provide a subsea wellhead apparatus that allows, at the option of the operator, disposing of wastes by injecting them into an annulus communicating with a fractured subterranean formation.

It is a specific object of this invention to provide a subsea wellhead apparatus that allows the operator to inject wastes in a fluid form into an annular space in a wellbore penetrating subterranean formations and thence into a fractured subterranean formation without fracturing back to the surface of the earth, such as at the bottom of the sea.

These and other objects will become apparent from the descriptive matter hereinafter, particularly when taken into conjunction with the appended drawings.

In accordance with this invention there is provided in floating rig drilling an improved subsea wellhead apparatus for use at the bottom of the sea and the like and for permitting injection of fluid wastes containing noxious, or toxic substances into an annulus and thence into a fractured formation. The subsea wellhead apparatus includes the usual plurality of strings of conduit suspended in a borehole penetrating the subterranean formation below the bottom and defining respective annular spaces therebetween; and a wellhead and accessories disposed above the bottom and the plurality of strings of conduit in a conventional interconnection between the floating rig and the wellhead. The improvement comprises a first communication aperture communicating with the annular space communicating with the fractured formation; conduit means for fluid flow connected with the first communication aperture and defining a sealed flowpath for flow of the fluid; remotely operable, high pressure flow control valve means interposed in the conduit means for controlling flow of the fluid between the annular space and the rig; and a remote control means for controlling the flow control valve means; the remote control means being operably connected with the flow control valve means so as to be operable to open and shut the flow control valve means responsive to an appropriate signal from a remote source, such as a surface ship or structure.

DESCRIPTION OF PREFERRED EMBODIMENT(S)

Ordinarily, drillers have to throw away the rock that is drilled and have to convert it into a fluid form, almost like a straight liquid. In fact, it may be in a slurry or the like that throws away about 75 percent or more of the rock that is drilled out of the subterranean formations. Since the suspended solids in the fluids that are discharged are controlled to a level below about 5 percent, a tremendous amount of volume has to be discharged. If one is to obtain optimum drilling efficiencies it becomes desirable to inject the discharged fluids into a fractured formation that does not fracture back to the surface. The regulating agencies that protect the environment do not want to approve permits to discharge something like 25,000 extra barrels of fluid where they have been used to seeing jackup rigs drillings with much lower discharges.

It is to be realized that any of a plurality of annular spaces could be employed for injecting into a subterranean formation as long as the subterranean formation was deep enough that it did not fracture back to the surface and discharge any of the wastes into the bottom of the sea or the like. From the point of view of this application, the injection would be described with respect to injecting into the annulus between the 20 inch and the 13⅜ inch casings.

Substantially the same equipment modifications would enable injecting between the 9⅝ and the 13⅜ inch casing if such was desired. The modifier of the equipment must avoid compromising the integrity of the wellhead, however. The two annuluses that appear most desirable are the annulus between the 9⅝ inch casing and the 13⅜ inch casing and the annulus between the 13⅜ casing and the 18⅝ inch casing.

Injecting between the 20 inch and the 30 inch surface strings would cause fracturing back to the surface and would be undesirable.

Accordingly, this invention will be described with respect to injecting into the annulus between the 13⅜ inch casing and the 18⅝ inch casing. In accordance with conventional practice, this annulus will be completed in communication with a fractured subterranean formation that is deep enough not to fracture back to the surface when fluids are injected at the circulation pressure.

Figure 1:
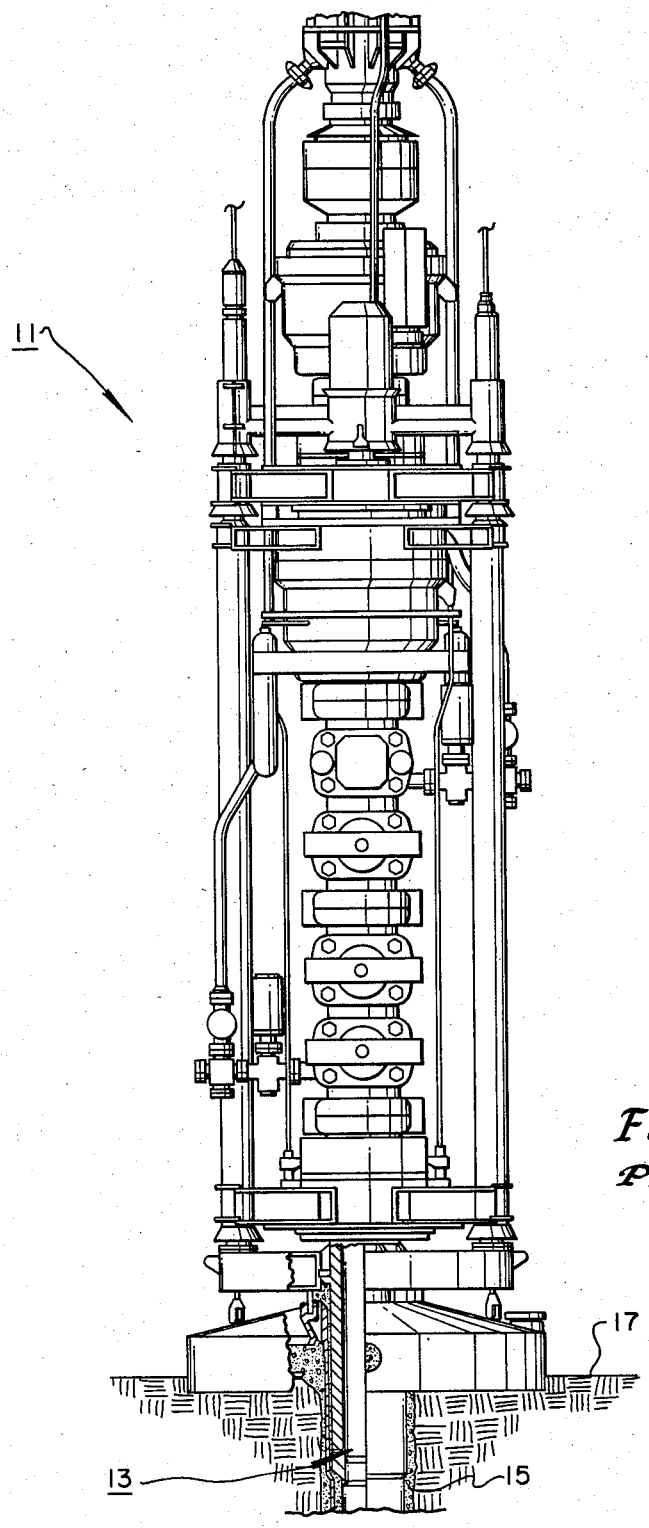
Fig. 1 Prior Art
FIG. 1 is an isometric view of a typical wellhead apparatus.
Figure 2:
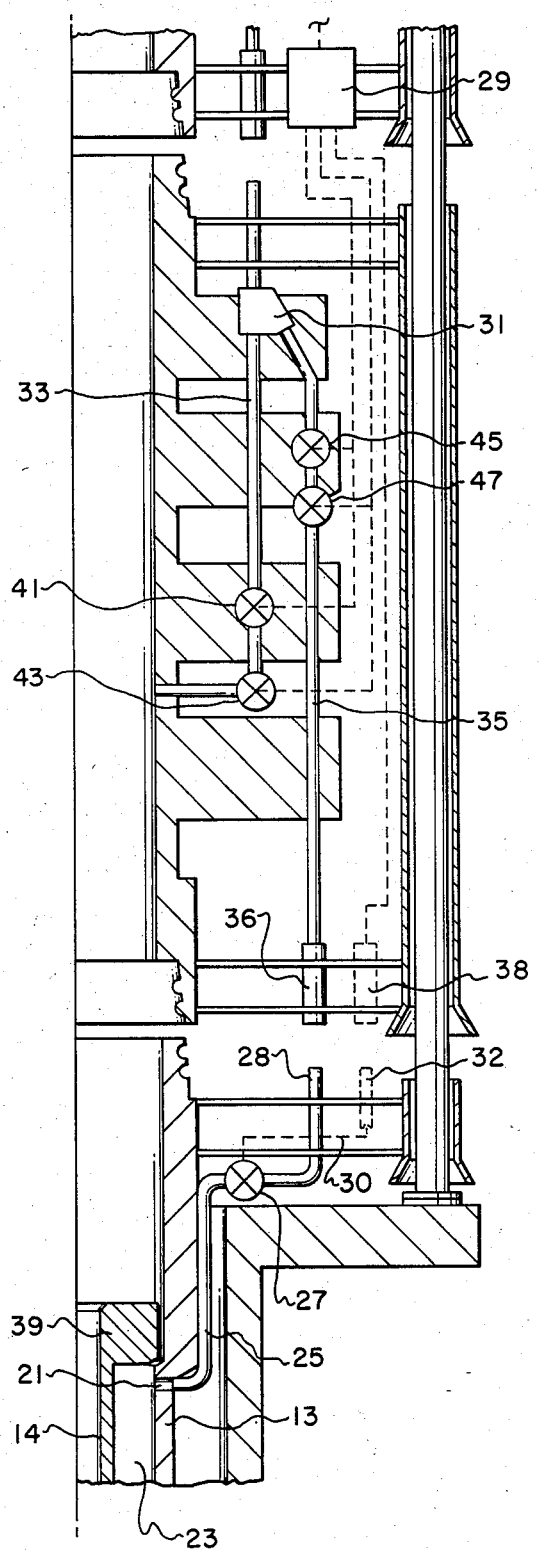
FIG. 2 is a schematic view of a wellhead apparatus in accordance with a specific embodiment of this invention.

Referring to FIGS. 1 and 2, this subsea wellhead apparatus 11 includes the conventional plurality of strings of conduit 13 suspended in a borehole 15 penetrating subterranean formations below the bottom 17 of the sea and the like; and a wellhead and accessories 19 disposed above the bottom and the plurality of the strings of conduit.

The subsea wellhead apparatus 11 also includes the improvement in accordance with this invention of having a first aperture 21, FIG. 2, communicating with a first annular spaces, or annulus, 23, intermediate the respective strings of conduit 13, 14; conduit means 25, connected with the first communication aperture and defining a sealed path for flow of the fluid; high pressure control valve means 27 interposed in the conduit means 25 for controlling flow of fluid between the annular spaces; and remote control means 29 connected with the high pressure flow control valves so as to be operable to open and shut the flow control valves responsive to a remote signal, as from the floating rig (not shown).

Referring to FIGS. 1 and 2, the plurality of conduit may be respective strings of tubing and casing that are disposed annularly within the well and sealingly connected with the wellhead and accessories at the open end and extending downwardly in the borehole from the bottom 17 so as to define respective annular spaces penetrating the subterranean formation penetrated by the borehole 15. The respective design criteria for the respective strings are conventional and need not be described in detail herein. The most common casing program for the kind of well that would advantageously employ this invention would be a 30 inch conductor pipe drilled or jetted to depths ranging from 75 feet to about 300 feet, 20 inch conductor pipe placed and cemented in a drilled hole at depths of 500 to 1,500 feet below the sea floor; 13⅜ inch surface casing set at depths ranging from 3,000 to 4,500 feet below the sea floor. The 9⅝ inch protection casing string would typically be set in the range of 8,000 to 15,000 feet below the sea floor. In order for the injection scheme of this invention to work most advantageously, the height of the cement on the 13⅜ inch casing must be limited to a depth below the bottom of the 20 inch casing. This is necessary to provide an interval of uncemented open hole that can be fractured for injection of the wastes.

The conventional drill strings are also employed. Of course, drilling mud is returned to the floating drilling rig and a shale shaker or the like is used to retain cuttings for geological information as desired.

Conventional pumping and drilling is employed in this invention in accordance with that ordinarily practiced with the floating drilling rigs.

The borehole is a conventional borehole such as is ordinarily drilled or jetted and may range from more than thirty inch (30") in size down to the smaller diameter necessary for the centermost string. In any event, the borehole drilling is conventional, employing conventional drilling bits and need not be described in detail herein.

Similarly the sea bottom 17 is well recognized and has no particular significance so does not need to be described in detail herein. Ordinarily, the sea bottom in which this invention has most usefulness is a sea bottom in which release of fluids containing noxious substances will be restricted.

The wellhead and accessories 19 may comprise a wide variety depending upon the complexity of the particular drilling and completion operation. Ordinarily a temporary guide base and a permanent guide base are put down first. Thereafter a wellhead connector will be emplaced as by running down guide cables or the like. If desired, and particularly on a drilling well at the high pressure or unknown regions, blowout preventors will be employed and these may comprise lower rim preventers and even lower and upper annular preventers. Frequently an LMRP (Lower Marine Rise Package) connector, such as a type ELR connector from Hughes, will be employed between an upper ball joint assembly and the lower blowout preventers. Frequently a Hughes HMF riser adapter and drilling riser will be employed to complete the connection to the string containing the innermost string of tubing and the next string of conduit affording annular communication back to the surface.

The aperture 21 communicates with its annular space 23 for injecting the fluid waste. The aperture 21 is also in fluid communication with the conduit means 25 which contains the control valve means 27 and terminates in the stab end 28. The high pressure control valve 27 has a control conduit shown by a dashed line 30 that terminates in the stab end 32. As illustrated in FIG. 2, a Y-block connector 31 in effect taps into an existing choke line 33 with a conduit means 35. The conduit means 35 terminates in a stab connector 36 that overrides and sealingly joins with the stab end 28. The existing choke line 33 has high pressure valves 41, 43 that effectively close off the line under the influence of suitable hydraulic signal, such as high pressure. Oppositely acting control valves are disposed in the conduit means 35 and open that conduit means when given the same signal, such as high pressure hydraulic signal by means of the control means 29. Ordinarily, the valves 45 and 47 are opened after the stab connection has been made between the stab end 28 and the stab connection 36. The same time the stab connection is made between the stab end 28 and the stab connection 36, a high pressure hydraulic stab connector 38 is stabbed into sealing connection with the stab end 32 on the high pressure hydraulic control line. Thus, the control valve means 27 is opened to provide fluid flowpath through the conduit means 25 through the aperture 21 for injecting the wastes into the annulus 23.

As implied from the foregoing, the conduit means 25 may comprise either added pipe, such as pipe 35; hose such as Coflexit hose; or other suitable conduit for containing the pressure and conducting the fluid back into an annular space as desired.

The high pressure control valve means will ordinarily be high pressure control valves such as the schematically illustrated valves 41, 43, 45, 47 and 27. The high pressure control valves can be controlled remotely, as by hydraulic pressure from respective hydraulic pressure source. It is preferred to have redundant valves 41, 43 for safety.

A suitable design of the valves, one set can be closed and another set can be opened by high pressure hydraulic pressure such that the valves can be operated simultaneously. If desired, on the other hand, each respective valve can have a unique signal, although the latter is unnecessarily complex for the ordinary drilling situation.

For example, the high pressure valves are installed to control flow to port 21 that communicates with the high pressure wellhead between the respective strings of conduit; for example, between a 13⅜ inch string hanger 39 in the bottom of a wellhead. The hydraulic connection from a control pod is run with the stack and connect with a line to the valves installed on the wellhead. This invention will involve emplacing a special piece of equipment that is required and to do so requires orienting the wellhead. Since modern practices to install 18⅜" 10,000 psi wellheads under the rig floor adding guide arms to this head is not a major difficulty.

Probably the best location for installing a port, or aperture 21 is between the 13⅜ inch casing and the 20 inch conductor pipe.

Additional remotely controlled, normally closed valves need to be attached to the wellhead. Depending upon the wellhead manufacturer, it may be advantageous to place these valves near the top of the wellhead and route the connection through a port coming up from the 18¾ inch 10,000 psi wellhead. The valves then need to be routed to a normal guide structure stab position that uses the same type connection as is used to connect the choke line or the kill line between the lower marine riser packets in the top of the preventer stack. Connections for the hydraulic control valves lines that operate the two normally controlled valves are provided with two sets of connections to give a level of redundancy for operating the high pressure flow control valves. The blowout preventer stack choke line is modified to include a Y-block connector, as shown in FIG. 2 and the respective isolation valves to route the injected fluid waste from the Y-block connector through the isolation valves to the kill line stab connector that has been added to the hydraulic connector guide frame at the bottom of the stack.

On the other hand, if desired single control injection valves may be employed on the respective sides of the stab connections. As is recognized, the stab connections for the conduit means, as well as stab connections for the hydraulic control lines for the injection valve, have the suitable male inserts, or ends, that are stabbed onto a funnel-shaped, wider female connectors with suitable check valves on their respective ends or at least on one of the respective ends, to prevent unwanted backflow.

The remote control means 29 is a conventional piece of apparatus. An additional hydraulic shuttle valve for each of the respective valves to be controlled, or set of valves as the case may be, may be installed and connected by suitable hydraulic line to a surface ship or the like to give a control signal to control the high pressure flow control valves for routing the fluid as desired.

The subsea control pod system has at least two unused hydraulic control line ports to operate the additional valves. The most difficult portion of the modification is the placement of the three stab connections and the lowermost valve operator connections on the bottom of the stack. The wellhead manufacturers will build their particular wellheads to fit these particular designs.

In operation, a suitable temporary guide base may be installed at a well site to be drilled. The permanent guide base and the desired drilling strings are installed. As previously indicated, the 30 inch conductor pipe is installed by having the borehole drilled or jetted to emplace the 30 inch conductor pipe and cement is returned to the sea floor. Similarly, the 20 inch conductor pipe is cemented in place after the borehole is drilled with returns to the sea floor. No other strings are cemented to the sea floor. On the remaining strings all returns from the other strings must come up the riser to the surface to check returns. Any excess is stored as a waste fluid to be displaced into the annulus space in accordance with this invention. Specifically, the remainder of the wellhead accessories and the like are emplaced as in conventional floating rig drilling. Of course, blowout preventors are installed when any unknown formation has a chance for causing trouble with excessive pressure. The wellhead apparatus will have been modified in accordance with this invention, for example as illustrated in FIG. 2, such that when emplaced, suitable returns can be effected through a sealed conductor path to the port 21 for getting rid of waste to the annulus 23 and thence to the fractured formation with which it communicates.

Specifically, when enough waste fluid has been accumulated, as in a barge or the like, the riser line 33 has its high pressure control valves 41, 43 closed off so that the waste fluid is not injected into main opening. Simultaneously, high pressure control valves 45 and 47 and high pressure control valve 27 are opened to open the conduit flowpath to the port 21 and enable injecting the waste material into the annulus 23 and into the fractured formation with which it communicates.

As indicated hereinbefore, the particular annulus is not especially critical as long as the precautions that have been set out hereinbefore are observed.

From the foregoing it can be seen that this invention accomplished the object delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In a subsea wellhead apparatus for use at a bottom of a sea and the like and with a floating drilling rig with a subsea blowout preventer stack for permitting injection of a waste fluid containing noxious, or toxic, substances into a fractured formation penetrated by a drilled borehole while drilling and including:

a. a plurality of strings of conduit suspended in a borehole penetrating subterranean formations below the bottom defining respective annular spaces therebetween and having conventional drilling strings of conduit operable for drilling, and b. a wellhead and accessories disposed above the bottom and sealingly connected with said plurality of strings of conduit so as to prevent unwanted invasion of fluids into said annular spaces;

the improvement comprising:

c. a first communicating aperture communicating with a first annular space intermediate a pair of said plurality of strings of conduit;

d. additional conduit means for fluid flow connected with said first communicating aperture and defining a sealed path for flow of the waste fluid;

e. remotely operable, high pressure flow control valve means interposed in said additional conduit means of element d. for controlling flow of the fluid to said annular space; and f. remote control means for controlling said flow control valve; said remote control means being operably connected to said flow control valve and operable to open and shut said flow control valve responsive to a remote signal, whereby said waste fluid can be injected into said annular space without having to transport said waste fluid back to a disposal site.

2. The subsea wellhead apparatus of claim 1 wherein said conduit means, flow control valve means and remote control means comprise respective control pod and wellhead having a blowout preventer stack choke line that is modified to include a Y-block connector and isolation valves that control a conduit means for routing the injected fluid waste to said annulus and fractured formation.

* * * * *